United States Patent [19]

Hale

[11] Patent Number: 4,723,751

[45] Date of Patent: Feb. 9, 1988

[54] INFLATABLE FORM FOR CONCRETE STRUCTURES

[76] Inventor: Loren E. Hale, 7301 E. 66 St., Tulsa, Okla. 74133

[21] Appl. No.: 888,455

[22] Filed: Jul. 21, 1986

Related U.S. Application Data

[63] Continuation-in-part of Ser. No. 671,791, Nov. 14, 1984, abandoned, which is a continuation of Ser. No. 421,566, Sep. 22, 1982, abandoned.

[51] Int. Cl.[4] ..... E04G 11/04

[52] U.S. Cl. ..... 249/13; 52/2; 249/65; 249/177; 249/179; 249/183; 264/32; 425/470

[58] Field of Search ..... 249/13, 10, 11, 65, 249/155, 178, 179, 183, 177, 212, 219 R; 425/111, 470; 264/32, 35, 309, 314; 52/2

[56] References Cited

U.S. PATENT DOCUMENTS

| | | | |
|---|---|---|---|
| 2,324,554 | 7/1943 | Billner | 264/314 |
| 2,624,931 | 1/1953 | Billner | 264/314 |
| 3,225,413 | 12/1965 | Bird et al. | 264/314 |
| 3,353,309 | 11/1967 | Kwake | 52/2 |
| 3,553,970 | 1/1971 | Wiswell, Jr. | 264/314 |
| 3,728,831 | 4/1973 | Bird | 52/2 |
| 3,924,363 | 12/1975 | Candle | 52/2 |
| 4,442,059 | 4/1984 | Boyce | 264/314 |

*Primary Examiner*—Jay H. Woo
*Assistant Examiner*—James C. Housel
*Attorney, Agent, or Firm*—Head & Johnson

[57] ABSTRACT

A cylindrical inflatable bag when inflated is used as a form for a concrete structure. A large number of parallel anchor straps extend around a portion of the cylinder in planes perpendicular to the longitudinal axis of the cylinder. Each strap is fixed to the inflatable form and has anchoring means on each end for securing to foundation anchors set in a foundation upon which the structure is to be constructed. The inflated bag is held in position by the straps. Reinforcing elements are supported on the outer surface of the bag. A cementitious material is then applied on an inflated bag to a thickness sufficient to cover the reinforcing elements. After the concrete is set, the bag is deflated removed with the straps for use at another site.

15 Claims, 16 Drawing Figures

Fig. 1

INFLATABLE FORM FOR CONCRETE STRUCTURES

This is a continuation-in-part of U.S. patent application Ser. No. 671,791, filed Nov. 14, 1984, entitled "Method of Constructing a Reinforced Concrete Structure," Loren Eugene Hale, inventor, now abandoned which application is a continuation of U.S. application Ser. No. 421,566, filed Sept. 22, 1982, now abandoned for a method of constructing a reinforced concrete structure, inventor, the said Loren Eugene Hale.

BACKGROUND OF THE INVENTION

1. Field of the Invention

This invention relates to construction of a reinforced concrete structure. More specifically, the invention relates to a novel apparatus to be used in a method of manufacturing an arched concrete structure, such as an arched culvert or bridge or drainage line by applying a cementitious composition on a pressurized inflatable form which is confined by steel straps or related means.

2. Description of the Prior Art

The basic concept of manufacturing a reinforced concrete/shotcrete structure such as a building, pipe, or the like, is generally a well-established art. However, when attempting to employ this art, a combination of removable and reusable inflatable molds or forms, the available alternative methods of construction are plagued with problems that severely limit the commercial acceptance of such techniques. Yet in principle, a reliable and safe construction technique using an inflatable mold and concrete/shotcrete should lead to an extremely cost effective and structurally acceptable product.

Among the problems encountered in fabricating concrete on an inflatable form has been the tendency for the form to be displaced and distorted when heavy loads of cementatious compositions are applied to the form. These problems have been further complicated by the tendency of the inflatable form to vibrate and transmit relative movement during application and setting of the concrete. Various methods and techniques have been suggested and employed to compensate for such problems, particularly, when building large scale cement shell structures and the like. For example, in U.S. Pat. No. 2,388,701, a "workdown" procedure for cementing a hemispherical "open bottomed," inflatable form mounted on a circular foundation is disclosed. This "workdown" procedure involves applying the cement to the top third of the form first, thus creating a compression on the rest of the form. However, it is recognized in this patent that such a procedure induces significant distortion to the side walls of the domed form and resulting structure. This distortion problem is again acknowledged in U.S. Pat. No. 2,892,239 (apparently the same inventor) and compensated for by the use of a series of horizontal reinforced bands placed at the base of the domed top resting on vertically straight side walls of a circular structure. The straight side walls are also reinforced by bands of wire mesh wrapped around the available form and again the workdown procedure is viewed as critical to create the desired structural stress.

Other patents of interest include the U.S. Pat. No. 4,442,059, issued Apr. 10, 1984, to "Rigid Building Frame With Inflatable Member," Norman A. Boyce, inventor. This patent relates to the building of a domed building. U.S. Pat. No. 3,139,464, issued June 30, 1964, to W. W. Byrd et al entitled "Building Construction." U.S. Pat. No. 3,973,749, issued Aug. 10, 1976, to Franz Friadle, et al, and is entitled "Hollow Form Work Elements for Producing Concrete Structures," and relates to reusable hollow form work elements of elastic material which may be used for the concreting of pipelines.

SUMMARY OF THE INVENTION

As set forth in my prior copending application said Ser. No. 671,791, I have discovered an improved method of fabrication using an entirely enclosed inflatable form confined by a plurality of preferrably steel bands or straps. In accordance with the method described in said application I anchor the first ends of a plurality of straps to a first row of anchors and anchor the second end of the strap to the second line of anchors. The lengths of the straps are such that when they are taught, they define the segment of a cylinder which will be the effective form. I inflate the balloon. Then I provide reinforcing elements on the outside of the inflated cylinder and hold the reinforced element a selected distance from the straps. Then I apply a wet cementitious material on the exterior of the inflatable form. In order to refine or improve this method I have conceived a new inflatable cylindrical form. In this invention I use a similar cylindrical form which is made of a flexible material. A plurality of anchoring straps are placed in selected positions along the surface of the flexible material. These straps are fixed in their selected positions along the inflatable bag, both when the inflatable bag or form is inflated or deflated. Preferably at least one end of each strap is provided with a plurality of anchoring means such as anchor holes which are spaced a selected distance apart. The other end may also have a plurality of anchoring holes. By selecting the proper anchoring hole and securing that selected hole to the foundation anchor, I define the effective length of the anchoring strap. This defines the form shape. After the concrete/shotcrete has been placed on the inflated form and allowed to set, the form is deflated. The ends of the anchor straps are disconnected from the foundation anchors and the inflatable forms with anchoring straps in fixed position thereto is then ready to be moved to a new location.

It is a primary object of the present invention to provide a reusable inflatable form and anchoring straps in unitary form which can be used over and over.

DETAILED DESCRIPTION OF THE INVENTION

Figure 1:
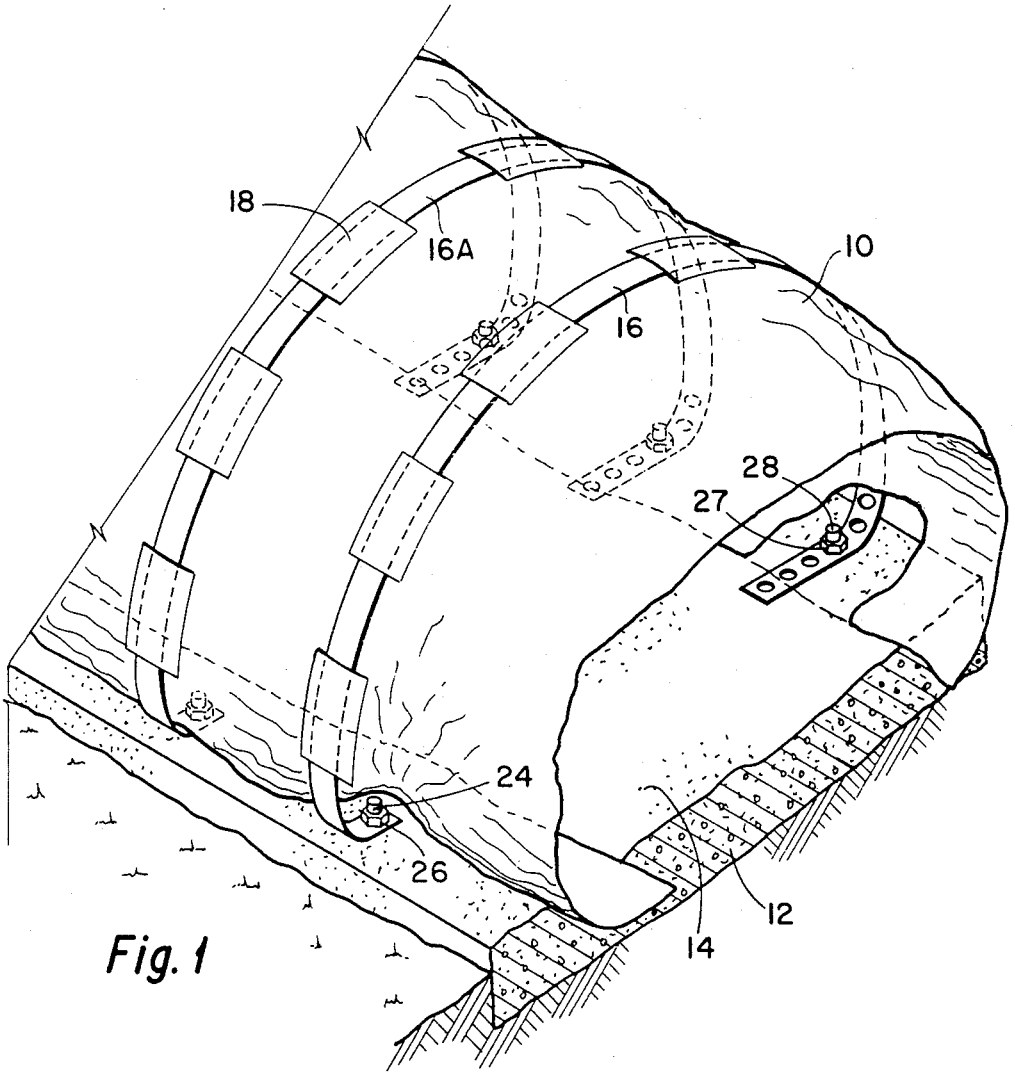
FIG. 1 is a perspective view of a segment of an inflated form utilizing my invention.
Figure 5:
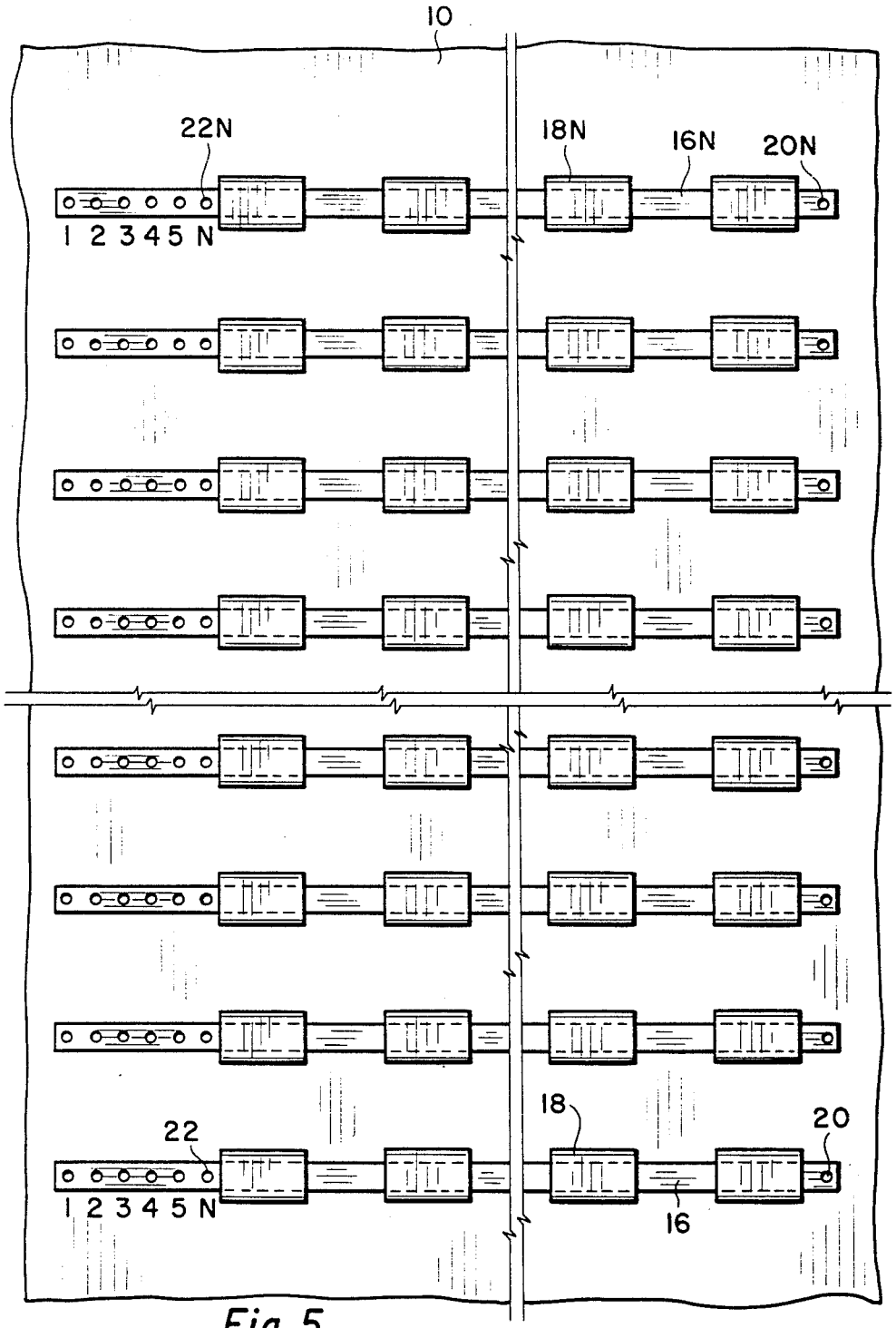
FIG. 5 illustrates the fixed straps on my inflatable form when it is lying flat.

Attention is first directed to FIG. 1 which shows a segment of inflated bag or inflatable form 10 supported by foundation 12. Bag 10 is a cylinder but the bottom portion has been cut away to illustrate the anchoring means and the floor 14 of the foundation 12. The form 10 is flexible and is essentially impermeable to air so that it can be inflated into a cylindrical form or portion of a cylinder. The material of the bag 10 should also be a kind that does not strongly adhere to cement so that the bag can be removed after the cement has set. The bag 10 is held in position by straps 16 and 16A. The straps 16 are preferably made of steel band material although not limited to that. The straps 16 are held in a selected position along the bag 10 by any securing means such as sleeves or pads 18 which may be of the same material as the bag 10 and are glued or otherwise secured to the bag itself. The straps are preferably slid through the sleeve 18 in a tight fit to hold the straps in position. If desired the straps may be fixed to the balloon by glue for example. As shown more clearly in FIG. 5, each straps 16 to 16N has at least an anchor hole 20 to 20N in one end and a plurality of anchor holes 22 to 22N in the other end. As shown in FIG. 5 this is a portion of the balloon or inflatable form lying flat. The straps 16 to 16N are at selected spaced distance apart. It is preferred that these be equally spaced. They are all fixed in position by the pads 18 to 18N. Other means of securing the straps 16 can be used so long as it fixes the position of the straps with respect to the bag 10. The center of each strap lies on a longitudinal line. Stated differently, the anchor holes 20 to 20N are aligned and each strap 16 has a plurality of anchor holes shown on the left side of the drawing. These are identified as position holes 1, 2, 3, 4, 5 and N. All the 1's position in a straight line, all the 2's are aligned and so forth.

Attention is directed back to FIG. 1 where on the left side of the drawing holes 20, 20N are positioned over foundation anchor bolts 24 secured thereto by nut 26. On the other end of the strap 16 anchor bolt 28 is inserted through selected holes in sets 22 to 22N and specifically through hole designated number 4 and secured by nut 27. Anchor bolts 26 and 28 are set or otherwise anchored in foundation 12. Each anchor bolt 28 is inserted through the hole specified as "4" in each set of anchor hole sets 22 to 22N. By properly selecting the specified holes 1, 2, 3, 4, or N, one can determine the length of each strap 16 very accurately. These straps are prefabricated. Thus, if I put anchor bolt 28 in the same designated hole for each strap 16, then I am assured that the effective length of the straps 16 to 16N are all equal. In most situations it is anticipated that anchor bolts 24 will all be aligned in a straight line and likewise anchor bolts 28 will also be in a straight line. However, there may be situations where we need to vary some from the absolute alignment and absolute equal length. I can, for example, then place some of anchor bolts 28 in position 1, the second in position 2, another in position 3 or however the desired geometry dictates.

Figure 2:
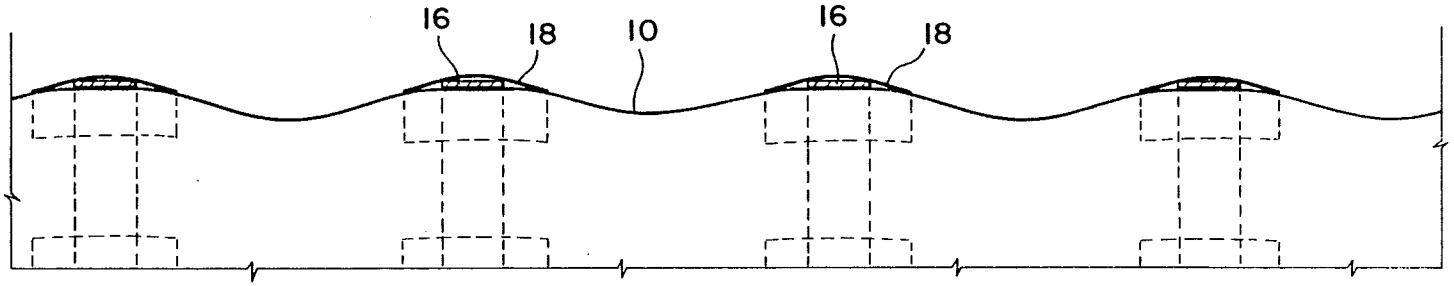
FIG. 2 illustrates a longitudinal contour of the deflated form.
Figure 6:
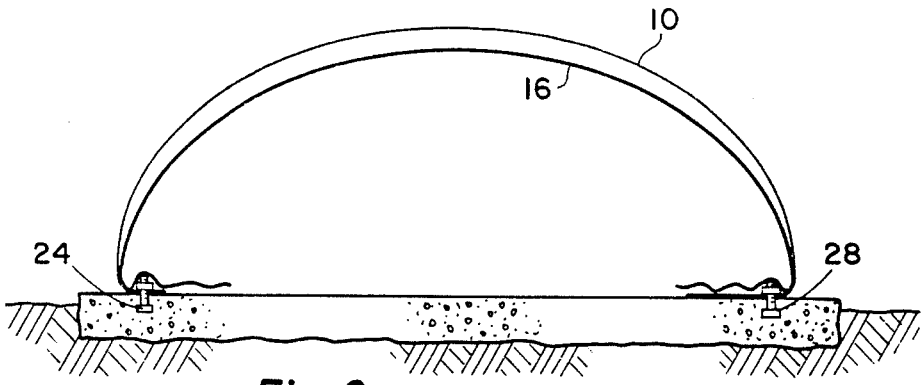
FIG. 6 is a schematic view showing the form inflated.

FIGS. 2 and 6 are illustrations showing the inflatable form 10 not yet inflated and held in position by straps 16.

Figure 4:
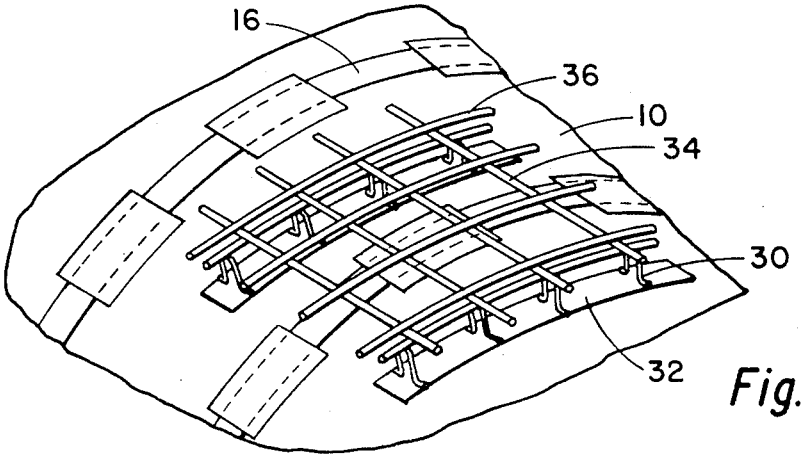
FIG. 4 illustrates one means of placing and supporting reinforcing rods on the outside surface of the inflated form.
Figure 3:
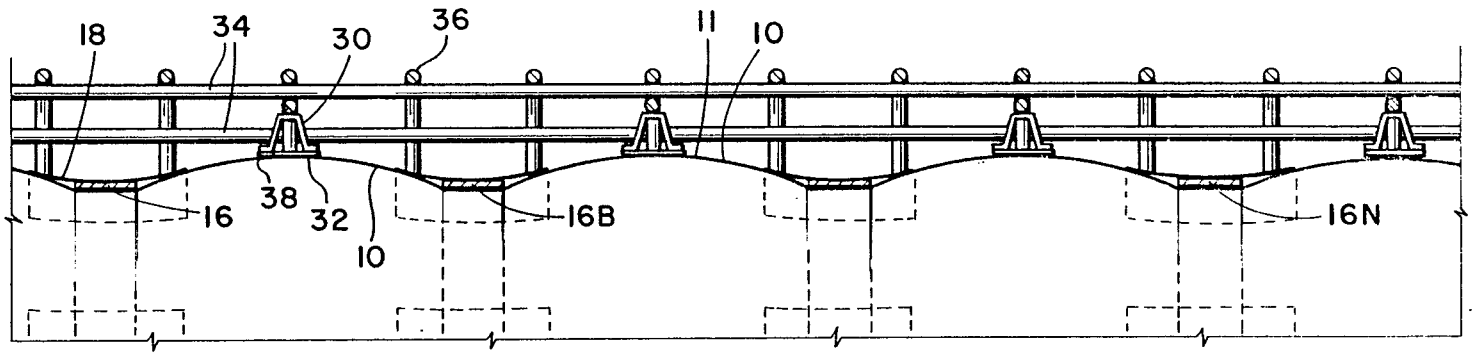
FIG. 3 illustrates along a longitudinal line the inflated form with concrete reinforcement elements.

As set forth in my parent application, said Ser. No. 671,791, reinforcing elements need to be provided on the top of inflated bag 10 before the cement is applied. A particular desirable arrangement of appying the reinforcing bars (rebars)is shown in FIGS. 4 and 3. A plurality of rebar height positioning elements include high chair 30 having an arcuate base 32 is provided on the crown between straps 16 and 16B along the entire length of the inflatable bag. As can be seen in FIG. 3, these high chair 30 holds the longitudinal bars 34 and traverse arcuate rebars 36 above the surface 38 of inflatable form 10. The rebars may be fastened together in a known manner such as by wire. FIG. 3 shows the inflatable form 10 inflated and held in position by strap 16 to 16N. Between the straps 16 there is a crest 11. Of course, the closer the straps 16 are together the less pronounced the crest 11 will be. The high chairs are set on this crest.

Figure 7:
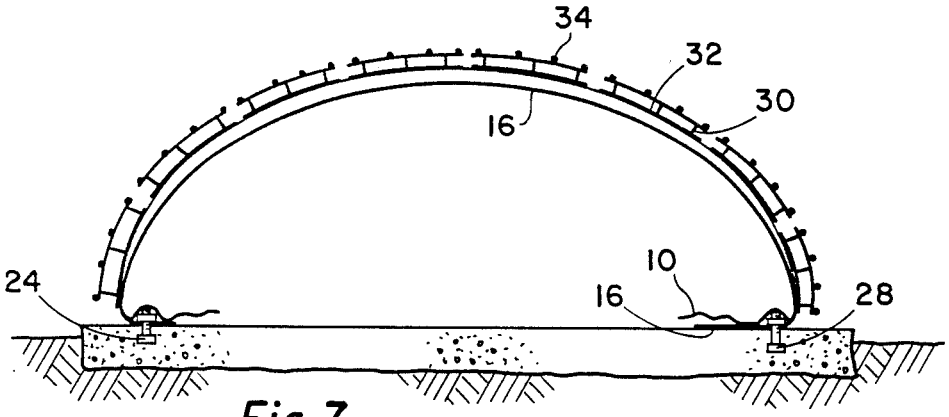
FIG. 7 is similar to FIG. 6 except reinforcing rods are placed thereon.
Figure 8:
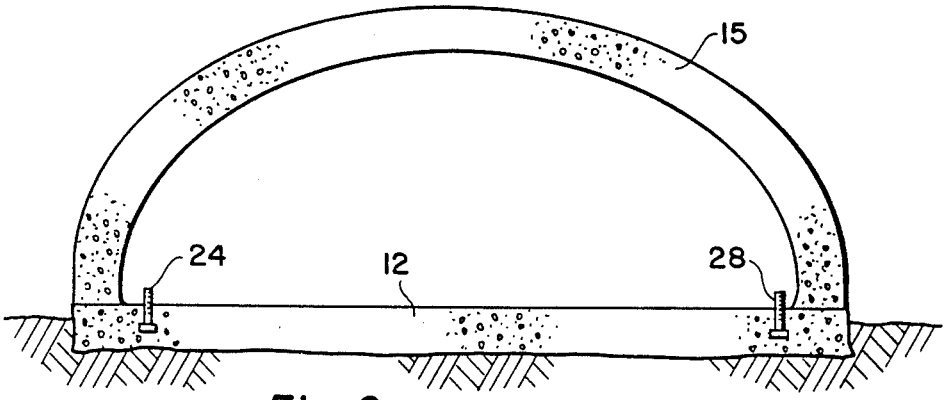
FIG. 8 illustrates a cross section after the concrete is set and the form deflated and removed.

FIG. 7 is a lateral schematic view corresponding to the longitudinal view shown in FIG. 3. It shows a strap 16 secured to foundation anchor bolts 24 and 28. After the inflatable form has been inflated to the position shown in FIGS. 3 and 7 and with the reinforcing bars attached as indicated therein, a cementitious material is applied to the outer side of inflatable form 10 where it completely covers the reinforcing bars to a selected thickness. This cementitious material can be applied by commercially available methods and can be done in one step. After the cementitious material has set, the inflatable bag 10 is deflated and nuts 26 and 27 are all removed. The deflated form 10 with fixed strap 16 is then removed from arch 15. The form 10 and straps are ready for use on another job. This permits straps 16 to be used over and over which is a cost-saving feature. More importantly the use of this system assures that the length of each strap 16 between opposite anchors is always accurate in that they do not have to be measured in the field. FIG. 8 shows a cement arch 15 in place. The base of the arcuate section 32 of the high chair system may be exposed to the interior of the arch. Therefore, it is desirable that it be coated with some corrosion resistant plastic or other protection.

Figure 10:
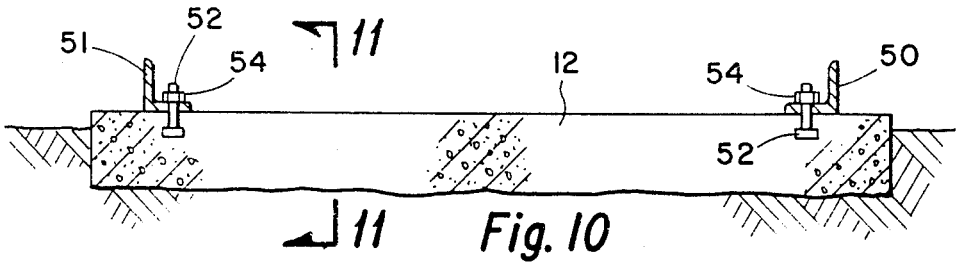
FIG. 10 is a view along line 10—10 of FIG. 9.
Figure 9:
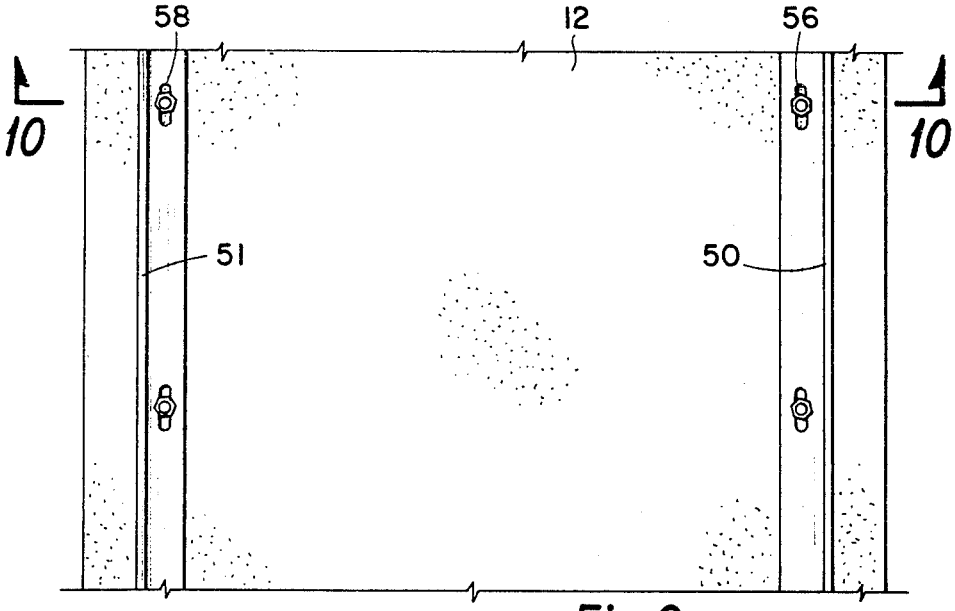
FIG. 9 is a partial view of a foundation showing foundation anchors.
Figure 11:
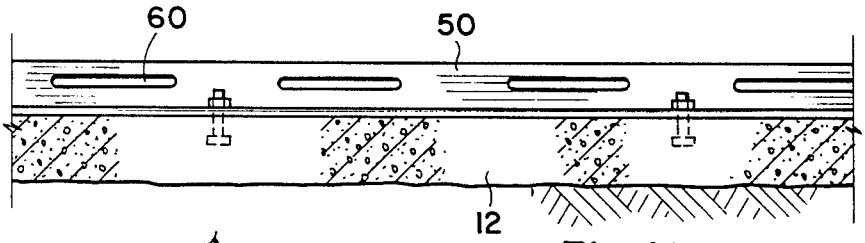
FIG. 11 is a view taken along the line 11—11 of FIG. 10.
Figure 12:
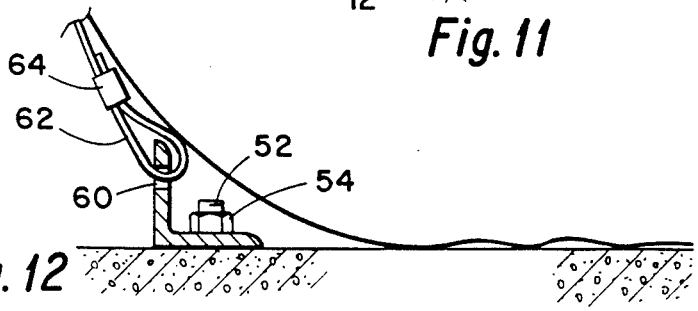
FIG. 12 illustrates the end of a strap of the inflatable form connected to the anchor of FIG. 9.

In FIGS. 1-8 the anchors attached to foundation 12 were foundations illustrated as a series of individual bolts 24 and 28. Various type foundation anchors can be used. One such foundation anchor is shown in FIGS. 9, 10, 11 and 12 and another embodiment of the foundation anchor is illustrated in FIGS. 13, 14, 15 and 16. Turning now to FIGS. 9, 10 and 11, there is shown a top view of a portion of the foundation 12 having a first angle iron anchor 50 held to the foundation 12 by anchor bolts 52 and nuts 54. These bolts 52 and 54 go through slots 56 and 58 respectively and angle iron guides 50 and 51 to give improved assembly location selection. A shown clearly in FIG. 11, the upright side of angle iron 50 is provided with a plurality of anchor slots 60. As shown in FIG. 12, it is through these anchor slots 60 that straps 62 are extended. The strap 62 is looped back and held in position by clamp 64. Unless the straps are over one-half the length of the circumference of the balloon, end straps will extend upwardly nearly vertically from the anchor. Strap 62 can be provided with a plurality of holes similarly as holes 22 in FIG. 5 and clamp 64 can be such that a selected one of the holes is held in the position within the clamp 64. Various clmaping means can be used.

Figure 13:
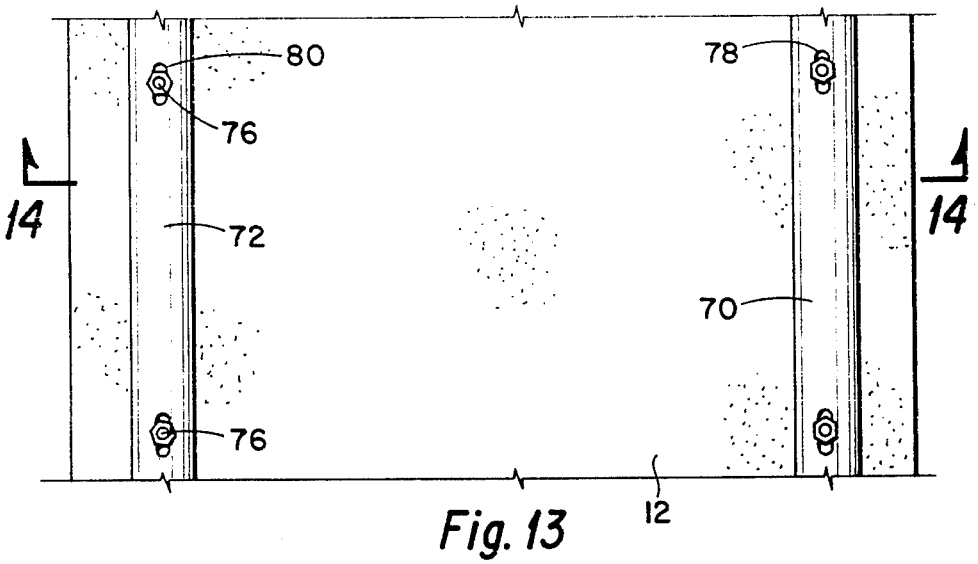
FIG. 13 is similar to FIG. 9 except it illustrates a different form of foundation anchor.
Figure 14:
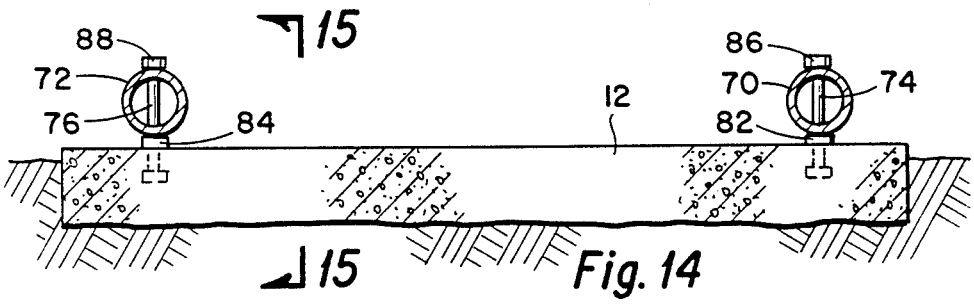
FIG. 14 is a view along the line 14—14 of FIG. 13.
Figure 15:
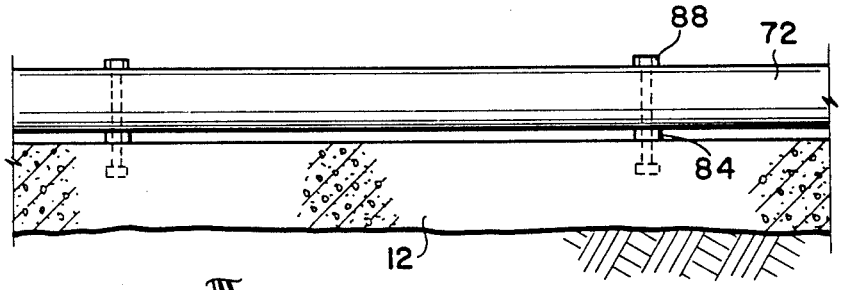
FIG. 15 is a view taken along the line 15—15 of FIG. 14.
Figure 16:
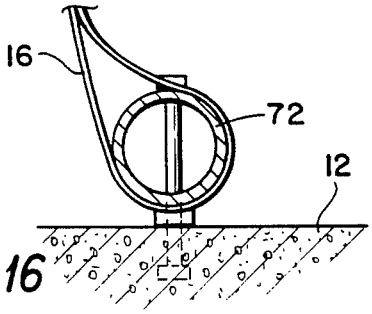
FIG. 16 shows the end of an anchoring strap anchored to the foundation anchors shown in FIG. 13.

Attention is next directed to FIGS. 13–16 which show another embodiment of the foundation anchor system. Shown especially in FIGS. 13 and 14 are two parallel tubings 70 and 72 which are anchored to the foundation 12 by bolts 74 and 76 which extends through slots 78 and 80 to permit ease of installing tubing members 70 and 72 in the event the spacings of the anchor bolt 76 are not completely accurate. The pipes 70 and 72 are held above foundation 12 by spacers 82 and 84, respectively. Nuts 86 and 88 hold the tubular members 70 and 72 to the anchor bolts 74 and 76 respectively. In this case the end of the strap 16 is looped around tubular member 72 as shown in FIG. 16 and is held in position by a clamp not shown but may be similar to clamp 64.

If I use the systems of FIGS. 9 to 12 when it is desired to move the form to another adjacent location I can merely unbolt nuts 54 and move the angle irons 50 and 52 with the straps 16 still attached. This saves a lot of time. This is also possible with the system of FIGS. 13 to 14. Further instead of settling anchor bolts in the foundation I can set coil nuts in the concrete. This saves cutting anchor bolts after the balloon and straps are removed.

To prevent the possibility of the embedment of the steel straps in concrete a removable barrier may be placed between the anchor and where the cement will be applied. This will permit one to unbolt its anchors.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. An inflatable form for use in building concrete type structures which comprises:

an entirely enclosed closed end cylindrical balloon;

straps of selected length which is less than the circumference of the cylindrical balloon, each strap having a center point;

anchor means on each end of each said strap;

a plurality of sleeve means attached to the form through which the straps extend for holding each said strap in a selected position along the wall of said cylindrical balloon such that when said balloon is inflated, each of said straps lies in a vertical plane which is parallel to the other vertical planes of the other straps and each said center lies in a straight line.

2. An inflatable form as defined in claim 1 in which there are a plurality of anchor positions on each said end of each said strap.

3. An inflatable form for use in building concrete structures comprising:

an entirely enclosed inflatable closed end cylindrical form made of flexible material and having a longitudinal axis;

a plurality of anchor straps located along the length of said form and fixed thereto, each strap being in a position such that each strap is in a plane perpendicular to said axis when said form is inflated.

4. An inflatable form as defined in claim 3 including a plurality of spaced anchors on at least one end of each said strap.

5. An inflatable form as defined in claim 3 including a plurality of spaced anchoring holes on at least one end of each said anchor straps.

6. An apparatus using an inflatable form for use in building concrete type structures on a foundation which comprises:

an inflatable entirely closed end cylindrical form made of a flexible air impervious material;

a plurality of anchoring straps in secured selected positions along the surface of said flexible material, each strap having a first end and a second end useful for anchoring.

7. An inflatable form as defined in claim 6 in which the length of each said strap is less than the circumference of said cylindrical form.

8. An inflatable form as defined in claim 7 in which the length of each strap is not over about one-half of the circumference of said cylindrical form.

9. An inflatable form as defined in claim 6 in which said straps are th in flexible steel straps and are fixed to the form.

10. An apparatus as defined in claim 6 including two spaced apart parallel anchor bars removably secured to said foundation, said bars having a plurality of spaced apart strap receiving slots.

11. An apparatus as defined in claim 6 including two spaced-apart parallel pipes secured to said foundation and spaced therefrom so that said strap may go under and wrap around said pipe.

12. An inflatable form for use in building concrete type structures which comprises:

a closed end cylindrical balloon;

anchor means on each end of said strap, each said anchor means having a plurality of anchor positions on each said end of each said strap;

means to hold each said strap in a selected position along the wall of said cylindrical balloon such that when said balloon is inflated said straps are in a vertical plane which is parallel to the other planes of the other straps and each said center line lies in a straight line.

13. An inflatable form for use in building concrete structures comprising:

an inflatable closed end cylindrical form made of flexible material and having a longitudinal axis;

a plurality of anchor straps located along the length of said form and fixed thereto, each strap being in a position such that each strap defines a plane which is perpendicular to said axis when said form is inflated;

a plurality of spaced anchoring holes on at least one end of each said anchoring strap.

14. An apparatus using an inflatable form for use in building concrete type structures on a foundation which comprises:

an inflatable closed end cylindrical form made of a flexible air impervious material;

a plurality of anchoring straps in secured selected positions along the surface of said flexible material, each strap having a first end and a second end useful for anchoring;

two spaced apart parallel anchor bars removably secured to said foundation, said bars having a plurality of spaced apart strap receiving slots.

15. An apparatus used in an inflatable form for use in building concrete type structures on a foundation which comprises:

an inflatable closed end cylindrical form made of a flexible air impervious material;

a plurality of anchoring straps in secured selected positions along the surface of said flexible material, each strap having a first end and a second end useful for anchoring;

two spaced apart parallel pipes secured to said foundation and spaced therefrom so that said strap goes under and wraps around said pipe and is secured back onto itself.

* * * * *